United States Patent [19]

Widman

[11] Patent Number: 4,549,451

[45] Date of Patent: Oct. 29, 1985

[54] PIERCING TOOL FOR MANIPULATING THE CLOSURES OF BEVERAGE CONTAINERS

[76] Inventor: Bruno Widman, 812 Oakton, Romeoville, Ill. 60441

[21] Appl. No.: 568,900

[22] Filed: Jan. 6, 1984

[51] Int. Cl.[4] ..... B67B 7/00

[52] U.S. Cl. ..... 81/3.47; 7/153

[58] Field of Search ..... 81/3.46 R, 3.47, 3.48, 81/3.38 R; 7/151, 152, 153

[56] References Cited

U.S. PATENT DOCUMENTS

| | | | |
|---|---|---|---|
| 2,836,998 | 6/1958 | White | 7/152 |
| 4,309,921 | 1/1982 | Miller | 81/3.46 R |
| 4,455,894 | 6/1984 | Roberts | 81/3.46 R |

FOREIGN PATENT DOCUMENTS

| | | | |
|---|---|---|---|
| 27609 | 7/1930 | Australia | 81/3.46 |
| 52562 | 1/1937 | Denmark | 81/3.46 |

*Primary Examiner*—James L. Jones, Jr.
*Attorney, Agent, or Firm*—A. G. Douvas

[57] ABSTRACT

A piercing tool for opening a metal container in which the tool has an elongated body which supports generally at one end of the body a curved piercing blade and a cooperating hook for engaging the container with the hook being disposed on the concave side of the blade. A modification comprising an elongated bar for opening additionally a container having a lid including a scored flap closure which is to be displaced into the interior of the container by a movable tab which is fixed by an intermediate anchor adjacent the flap closure with the tab including a handle portion located on one side of the tab anchor and adapted to be elevated relative the container lid and with the tab also including a closure depressing portion located on the other side of the tab anchor adjacent the flap closure. The elongated bar is disposed adjacent the convex side of the curved piercing blade approximately opposite the hook and is supported to define a tab receiving slot which when engaging the tab uses the convex surface of the piercing blade resting against the tab and the flap closure as a support defining a convex bearing surface with the bar elevating the tab and with both the tab and the convex surface of the blade depressing the flap closure to open the container. A recapper cup is located at an approximate center portion of the body whereby both press-fit and screw-type bottle caps may be manipulated with a full finger grip applying a palm exerted force against the recapper cup.

1 Claim, 7 Drawing Figures

PIERCING TOOL FOR MANIPULATING THE CLOSURES OF BEVERAGE CONTAINERS

BACKGROUND OF THE INVENTION

This invention relates to improvements in a particular type of prior art tool having a curved container piercing blade cooperating with an associated hook for engaging the container. In particular, these improvements relate to modifications by which a lift tab of a tab-top can is elevated by a lift bar, and also press-fit and screwtype bottle caps are manipulated by a recapper cup. A lift bar for actuating lift tabs is known in the prior art, see for example, U.S. Pat. No. 4,309,921; and recapper cups for applying press-fit beverage bottle caps are shown in U.S. Pat. No. Re. 23,731, U.S. Pat. Nos. 1,116,438, 1,422,970, 2,593,091, 2,641,397, 2,738,117, and 2,801,551. The inventor's earlier application Ser. No. 514,568 filed July 18, 1983 shows the adaptation of recapper cups for operating screw-type bottle caps.

None of this prior art discloses a tool having a piercing blade which has an associated lift-tab bar so that the flap closures of tab-top cans may also be opened. Additionally, the recapper cups of the prior art are disposed in a location which makes it difficult to apply a palm-exerted force.

SUMMARY OF THE INVENTION

Accordingly, a principal object of this invention is to expand the utility of tools having curved piercing blades so that lift tabs for tab-top cans, and also press-fit and screw-type bottle caps can be manipulated by the tool.

The foregoing object is attained in the present invention by modifying a tool having a curved piercing blade and an associated container engaging hook to include a bar which defines a lift-tab receiving slot. The bar is located on the convex side of the curved blade approximately opposite the hook. When the lift tab is inserted into the slot, the convex surface of the piercing blade rests against both the tab and the flap closure to insure an easy opening operation of the container.

As an optional feature, a recapper cup is located in the approximate center of the tool body so that the tool can be grasped with a full-fingered grip which will enable a palm exerted force to be applied to the recapper cup to insure more effective operation.

Accordingly, the container piercing tool not only serves its usual prior art function of opening metal containers by piercing, but also actuates container tabs to effect opening, removes pressfit and screw-type bottle caps, and reapplies press-fit caps more effectively.

DESCRIPTION OF THE DRAWINGS

In order that all of the structural features for attaining the objects of this invention may be readily understood, reference is herein made to the accompanying drawings wherein.

DETAILED DESCRIPTION OF THE PREFERRED EMBODIMENT

Figure 3:
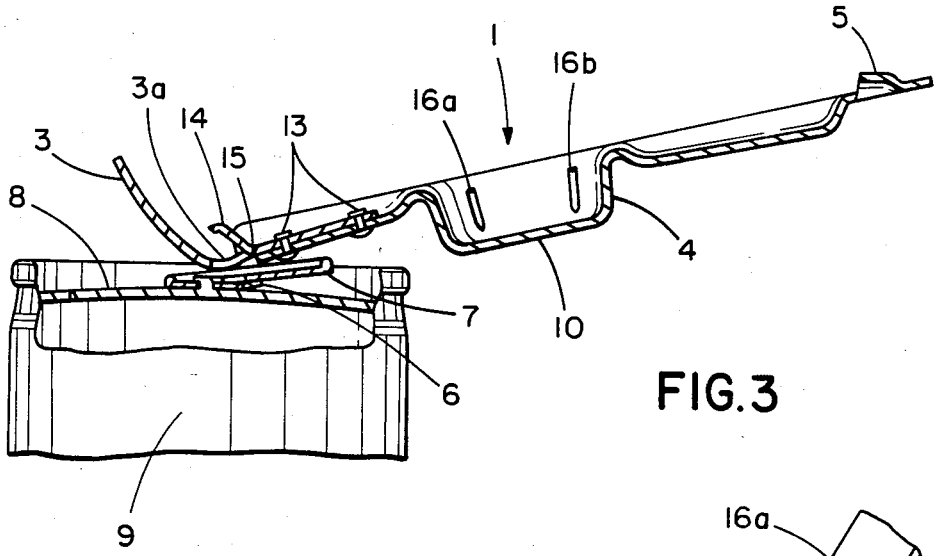
FIG. 3 is a section view taken along line 3—3 of FIG. 1 showing the tool bar engaging the lift tab of a metal beverage container.
Figure 4:
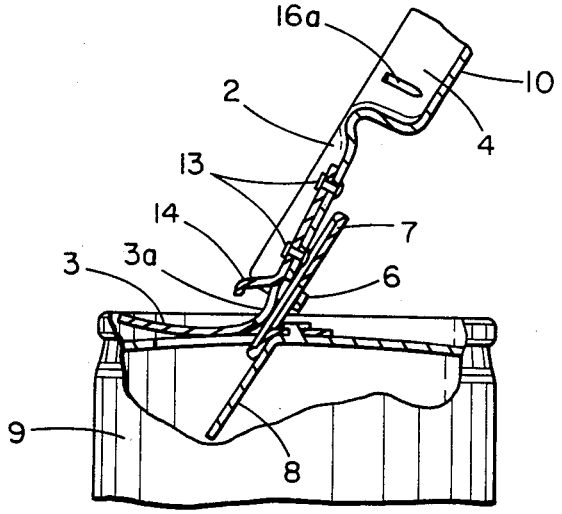
FIG. 4 is a fragmentary view, related to FIG. 3, which shows the lift tab sufficiently elevated to cause the flap closure to break away from the container.

Referring to the drawings, tool 1 is formed from a metal body 2 to include as principal elements a container piercing blade 3, a cup-like recapper 4, and a press-fit cap lever 5. All of the foregoing elements are individually known in the prior art. However, the tool of this invention advantageously associates lift-tab bar 6 with curved piercing blade 3 so that bar 6 can engage lift tab 7 (FIG. 3) and the convex curved surface of blade 3 can contact both tab 7 and flap closure 8 to open beverage can 9 (FIG. 4). Additionally, recapper 4 (which is shown in my U.S. Pat. No. 4,474,087, granted Oct. 2, 1984) is relocated to the approximate center of body 2 (FIG. 6). With this disposition a full-handed manual grip can be applied to body 2, with a palm-exerted force on top 10 of the recapper, so that a press-fit bottle cap (not shown) can be reapplied or alternatively a screw-type bottle cap 11 can be twisted on and off relative bottle 12 (FIGS. 5 and 7), as desired.

Press-fit cap lever 5 (also shown in my copending application) operates in a conventional manner to pry press-fit cap closures from bottles.

Container piercing blade 3 is preferably fabricated as a separate element and is fastened to body 2 by rivets 13. Body 2 and blade 3 require different metal characteristics in order to perform their respective functions. Accordingly, inexpensive manufacture is attained by producing these elements from different metals and then fastening the parts together.

The use of a curved piercing blade 3, together with an associated hook 14 is, of course, old in the art. Additionally, the use of a lift-tab bar is shown in U.S. Pat. No. 4,309,921. However, the inclusion of a lift-tab bar 6 parallel to and spaced from the convex surface 3*a* of blade 3 proximate the junction line 15 of blade 3 and body 2 results in an improved mode of operation. In particular, the convex surface of blade 3 is used as a curved bearing surface resting on both lift tab 7 and flap closure 8 enabling the manual elevation of bar 6 to uniformly and smoothly pry the engaged lift tab 7 (FIG. 4) and thereby firmly cam flap closure 8 into an open position by breaking flap 8 at scored line 8*a*. Bar 6 is also located adjacent hook 14, but on the opposite side of blade 3.

Figure 1:
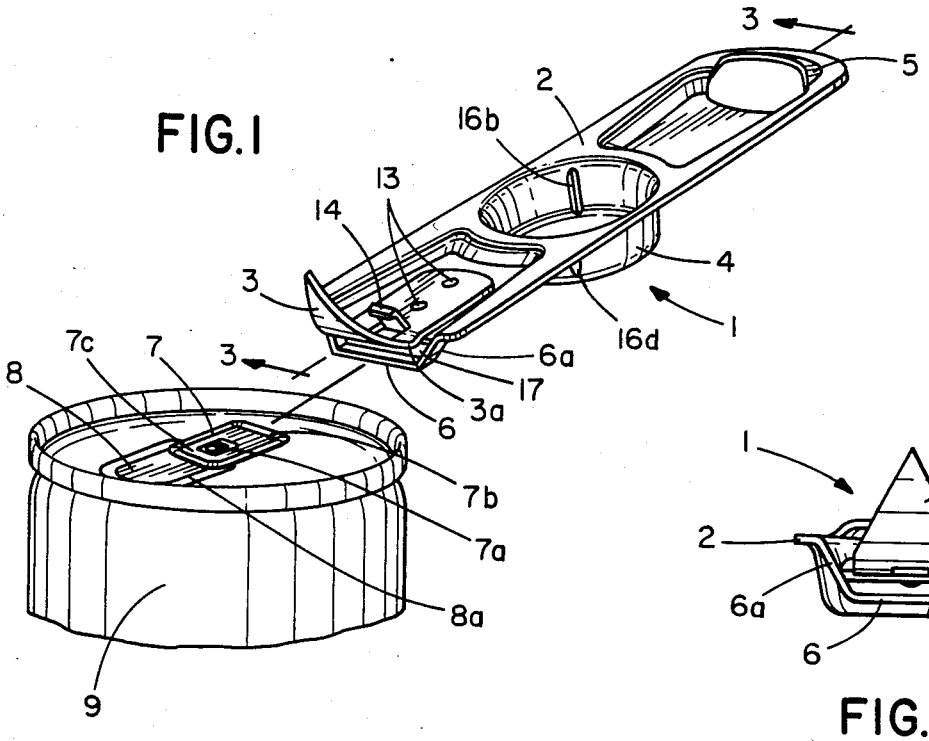
FIG. 1 is a perspective view showing the potential application of the tool of this invention to a tab-top container having a lift-top closure.
Figure 2:
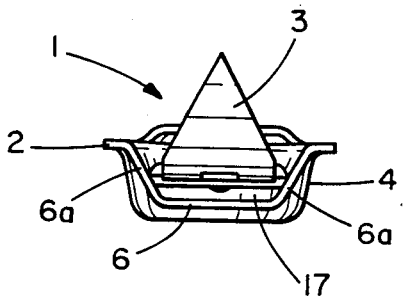
FIG. 2 is an end view of the tool showing the bar which engages the lift tab.

Lift-tab bar 6 is stamped from an end portion of metal body 2, with the ends of bar 6 being carried by supports 6*a* (FIGS. 1,2). Body 2, and bar 6 and its supports 6*a* are preferably integrally formed from the same metal piece from which body 2 is fabricated. Bar 6 and its two supports 6*a* define an elongated opening or slot 17 (FIG. 2) into which lift tab 7 is inserted when a beverage can is to be opened. Lift tab 7 is fixed to the container 9 lid by anchor 7*a* so that the tab is subdivided into a handle portion 7*b* and a flap-closure depressing portion 7*c*. When handle portion 7*b* is elevated relative the container lid, the flap-closure depressing portion *7c* is pivoted about anchor *7a* so as to pry open the container. The opening of the closure flap also assists the depressing force exerted by the convex surface of piercing blade 3 resting against the flap closure.

Figure 5:
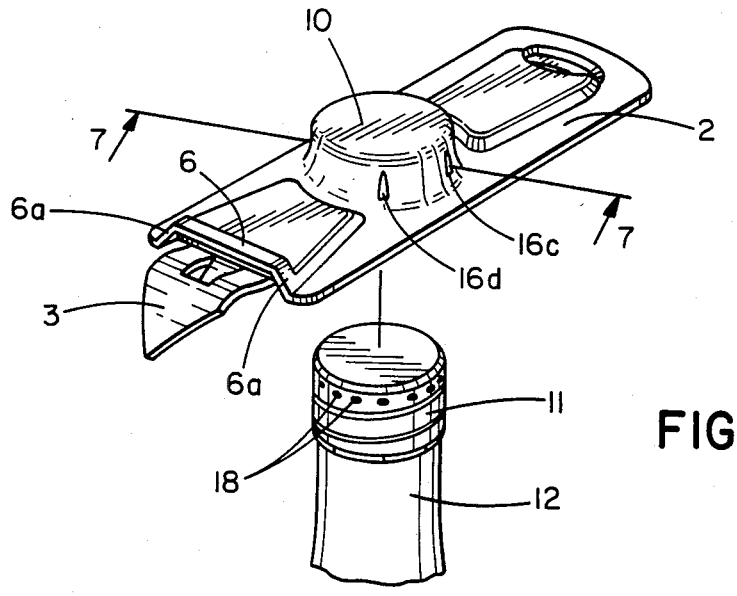
FIG. 5 is a perspective view showing the potential application of the tool to a beverage bottle having a screw-type container cap.
Figure 6:
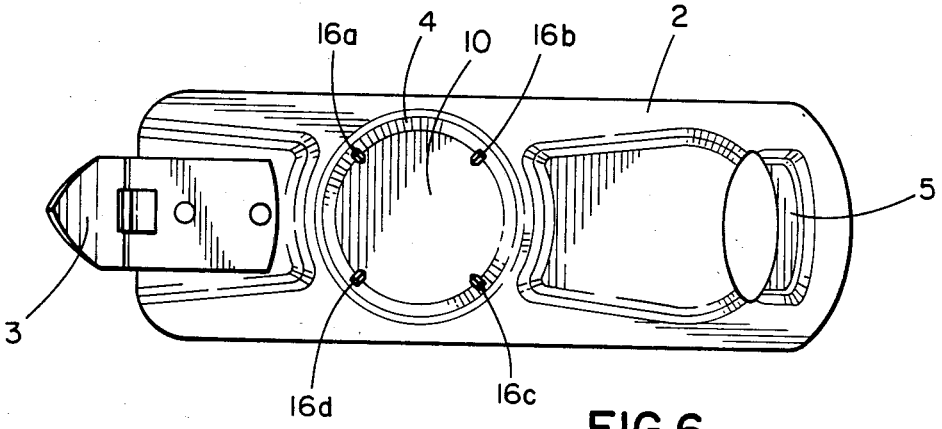
FIG. 6 is an elevation view showing the bottom of the tool.
Figure 7:
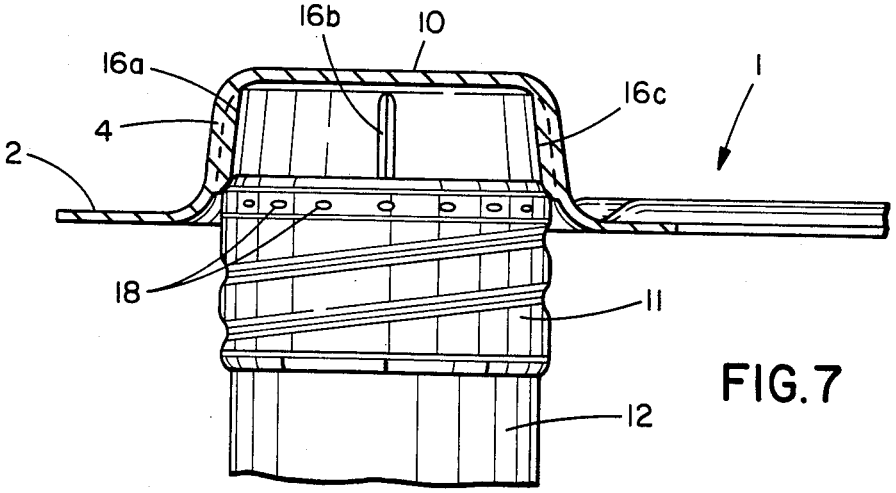
FIG. 7 is a view taken along line 7—7 of FIG. 5 which shows the engagement of the recapper lugs to a screw-type bottle cap.

Recapper 4 has a cup-like configuration which includes four inwardly projecting ribs 16*a,b,c,d.* These ribs provide means for engaging the projections of a screw-type bottle cap 11 (FIGS. 5, 7). In its application, tool 1 is lowered upon cap 11 so that ribs 16*a,b,c,d* tightly engage ribs or projections 18 formed on the exterior of cap 11. With a tight frictional engagement established between the ribs and the cap, by exerting a manual palm force on top 10 of recapper 4 with a full finger grip being applied to body 2, body 2 acting as a handle is rotated clockwise or counterclockwise as required to either twist on or twist off cap 11 by engaging or disengaging threads 19 of cap 11 with respect to the mating bottle thread.

Similarly, the palm-exerted force applied to the centrally disposed recapper 4 improves the recapping of press-fit bottle caps.

It should be understood that the above described embodiments are merely illustrative applications of the principles of this invention. Modifications can be made without departing from the scope of the invention.

What is claimed is:

1. In a piercing tool for opening a metal container in which the tool has an elongated body which supports generally at one end of the body a curved piercing blade which is tapered relative the width of the body to terminate in a piercing point and a cooperating hook for engaging the container with the hook being disposed on the concave side of the blade, the improvement for opening additionally a container having a lid including a scored flag closure which is to be displaced into the interior of the container by a movable tab which is fixed by an intermediate anchor adjacent the flap closure with the tab including a handle portion located on one side of the tab anchor and adapted to be elevated relative the container lid and with the tab also including a closure depressing portion located on the other side of the tab anchor adjacent the flap closure, comprising an elongated bar disposed adjacent the convex side of the curved piercing blade approximately opposite the hook and supported on the piercing tool to define a tab receiving slot which when engaging the tab uses the convex surface of the piercing blade resting against the tab and the flap closure as a support defining a convex bearing surface with the bar elevating the tab and with both the tab depressing portion and the convex surface of the blade depressing the flap closure to open the container and in which the piercing blade has a curved length approximately equal to the length of the scored flap closure so as to overlie the closure for at least substantially its entire length during a container opening operation.

* * * * *